US005892172A

United States Patent [19]

Candland et al.

[11] Patent Number: 5,892,172

[45] Date of Patent: Apr. 6, 1999

[54] PROPELLANT SYSTEM

[75] Inventors: Calvin T. Candland, Eden Prairie; James L. Kennedy, Bloomington, both of Minn.

[73] Assignee: Alliant Techsystems Inc., Hopkins, Minn.

[21] Appl. No.: 841,431

[22] Filed: Apr. 22, 1997

[51] Int. Cl.[6] ..... C06D 5/06; F42B 12/00

[52] U.S. Cl. ..... 102/288; 102/289; 102/292; 102/517

[58] Field of Search ..... 102/288, 289, 102/292, 517

[56] References Cited

U.S. PATENT DOCUMENTS

| | | | |
|---|---|---|---|
| 1,136,122 | 6/1915 | McJones | 60/39.47 |
| 1,920,075 | 7/1933 | Haenichen | 102/288 |
| 3,165,060 | 1/1965 | Braun et al. | 102/98 |
| 3,166,896 | 1/1965 | Breitengross, Jr. et al. | 60/35.6 |
| 3,195,302 | 7/1965 | Hughes et al. | 60/35.6 |
| 3,217,651 | 11/1965 | Braun et al. | 102/98 |
| 3,316,842 | 5/1967 | Schulz | 102/100 |
| 3,396,661 | 8/1968 | Michael | 102/103 |
| 3,429,265 | 2/1969 | Longwell et al. | 102/101 |
| 3,677,010 | 7/1972 | Fink et al. | 60/220 |
| 3,706,278 | 12/1972 | Stiefel et al. | 149/3 X |
| 3,811,380 | 5/1974 | Glass | 60/256 X |
| 4,408,534 | 10/1983 | Araki et al. | 102/288 |
| 4,581,998 | 4/1986 | Horst, Jr. et al. | 102/289 |
| 4,615,270 | 10/1986 | Bell | 102/289 |
| 4,627,352 | 12/1986 | Brachert et al. | 102/290 |
| 4,714,019 | 12/1987 | Lips et al. | 102/307 |
| 4,722,814 | 2/1988 | Waehner et al. | 264/3.4 |
| 4,758,287 | 7/1988 | Pietz | 102/291 X |
| 4,792,423 | 12/1988 | Craig et al. | 102/291 |
| 4,846,368 | 7/1989 | Goetz | 102/288 X |
| 4,876,962 | 10/1989 | Olsson | 102/288 |
| 5,000,885 | 3/1991 | Laird et al. | 264/3.1 |
| 5,101,730 | 4/1992 | Bender et al. | 102/288 |
| 5,345,873 | 9/1994 | Lauritzen et al. | 102/288 |
| 5,531,163 | 7/1996 | Dillehay et al. | 102/288 |
| 5,578,787 | 11/1996 | Kobari et al. | 102/288 |
| 5,610,365 | 3/1997 | Thiesen | 102/431 |

*Primary Examiner*—Peter A. Nelson
*Attorney, Agent, or Firm*—Nikolai, Mersereau & Dietz, PA

[57] ABSTRACT

An improved geometric propellant loading configuration for high velocity, large or medium caliber projectile ammunition is disclosed. The propellant system includes several mutually contiguous extrudable stick shapes that in concert result in highly efficient use of propellant load space. The system reduces loading, assembling and packing (LAP) labor and overall cost, yet provides a dense pattern to increase propellant load and high perforation to improve burning progressivity over prior stick loads and more reliable and improved ballistic performance.

12 Claims, 9 Drawing Sheets

PROPELLANT SYSTEM

ACKNOWLEDGEMENT

The present invention was made with the support of the United States Government pursuant to contracts DAAA21-86-C-0202 and DAAK11-84-C-0102 with the Department of the Army. Accordingly, the Government has certain rights in this application.

BACKGROUND OF THE INVENTION

I. Field of the Invention

The present invention is directed generally to the field of sophisticated, high velocity, large or medium caliber projectile ammunition and, more particularly, to an improved geometric propellant loading configuration for such ammunition. The propellant system of the invention includes several mutually contiguous extrudable stick shapes that in concert result in highly efficient use of propellant load space. The system reduces loading, assembling and packing (LAP) labor and overall cost, yet provides a dense pattern to increase propellant load and high perforation to improve burning progressivity over prior stick loads and more reliable and improved ballistic performance.

II. Related Art

The technology of large and medium caliber ordnance generally has evolved into the use of increasingly sophisticated projectiles and firing systems. Smaller diameter projectiles are often used together with discarding sabots that transfer momentum to the projectiles which develop very high velocity (Mach V+) and so very high kinetic energy (KE). The projectiles themselves have also become more aerodynamic and generally employ a plurality of stabilizing fins. These so-called munitions also may contain sophisticated highly sensitive target proximity detection devices which operate precision arming and detonating circuits. In addition to the electronic control and sensing improvements, the construction of the rounds themselves has undergone an evolution that has produced vastly improved capabilities in terms of the effect produced by a single round on a target.

Conventional ammunition of the class described, such as that fired by military tank cannons, are typically breech loaded and electrically activated and fired from within the tank. The projectiles typically are fired electrically using a primer circuit to ignite a primer which, in turn, ignites a main propellant charge by DC voltage from a thermal battery activated by the primer. The projectile may contain electronics activated when firing occurs and which utilize memory storage to operate a preprogrammed target acquisition or proximity system and the arming and detonating devices in the shell during the flight of the shell. Then, it is apparent that large caliber ammunition, with respect to target acquisition, proximity detection, arming and detonating, has become very sophisticated.

While all these developments are interesting and important to the advancement of the art, the success of all ammunition projectiles still depends greatly upon the performance, and reproducibility of the performance of the associated propellant system. A variety of techniques have been tried in order to improve ammunition muzzle velocity by increasing propellant charge density, i.e., increasing the amount of propellant per available cartridge volume unit and/or the progressivity of the burn by providing an ever increasing surface area. These techniques have included utilizing various preformed shapes packed into the cartridge in an effort to increase density while minimizing adverse effects on burning rate. Such techniques have included the use of various sizes of granular extruded (short grain) propellant shapes, perforated stick extruded shapes which are long and cylindrical or hexagonal in external geometry and represent the most commonly used stick shapes. These sticks are commonly provided with 7 or 19 longitudinal perforations (7 P or 19 P).

Several configurations of slab and disk-shaped propellant geometries are illustrated in co-pending application Ser. No. 08/537,882, filed Apr. 10, 1996, now U.S. Pat. No. 5,712,445, issued Jan. 27, 1998, and assigned to the same assignee as the present application, the contents of which are deemed incorporated by reference herein for any purpose. Another configuration is in the form of a rolled sheet of propellant. Bulk liquid propellants have also been used; however, they tend to burn in a non-reproducible manner and, therefore, results have been unpredictable.

FIG. 1 depicts a typical large caliber round, which may be fired from the main turret cannon of a tank or other artillery piece, loaded with propellant of one prior art type. The round is shown generally at 10 at FIG. 1 and includes a base plate section 12 connected with the wall of a cartridge casing and having a generally cylindrical portion 14 and a necked down or tapered upper portion 16. Except for the base plate 12, the shell or cartridge sidewall 14 itself is normally made of a combustible material such as molded nitrocellulose or other such material itself consumed during the firing of the shell. A projectile is shown at 18 with discarding sabot members 20 and 22 which peel away and drop off just after the projectile is discharged from the muzzle of the cannon. A plurality of stabilizing guidance fins (normally six in number) as at 24 are also provided. The nose cone section 26 may contain an electronics package and the warhead section 28 may contain arming and detonating circuitry.

With respect to the firing of the shell, a primer housing shown generally at 30 contains a conductive ignition electrode or primer button (not shown) and stub base 31. The primer housing and stub base are connected with a generally hollow brass or other type metal center-core primer tube 32 which has a plurality of openings as at 34 which access and address the general propellant charge volume 36. The propellant illustrated consists of closely packed, generally uniformly shaped, perforated, granular solid propellant grains 38 (FIG. 1B) perhaps 2 to 3 cm long by about 0.5 cm in diameter.

The shell is normally fired electrically using direct current to ignite the primer in the primer housing and through the primer tube 32, thereby igniting the main propellant 38 via the openings 34. In accordance with an important aspect of performance, i.e., achieving the highest, repeatable muzzle velocity for the projectile, however, it is desirable that the propellant, during the burn, generate gases at an ever increasing rate as the projectile advances along the barrel. Accordingly, a configuration of propellant which creates predictably and ever increasing burn surface area as the burn progresses is very desirable.

The present standard is based on the performance of stick propellant, particularly the round extruded stick shape which has increased shell velocities over earlier propellant loadings. However, a great many relatively small diameter sticks must be used, and the stick propellant has also presented difficulties with respect to achieving high loading density (FIGS. 2A, 2B, 3).

The loading process for a cartridge using stick propellant is also very labor intensive and performance is not optimum because adjacent surfaces of the sticks do not match, as in the case of random placement with granular propellant. The method used to extrude both stick and granular propellant includes pins that create perforations during the process. With sticks of present size (below), this method may create perforation and web inconsistencies which actually reduce the propellant performance.

Repeatability of acceptable or good performance of stick propellant also requires uniformity of the notch or kerf size and web between the kerfs for proper burning. The current processes of extrusion and kerf cutting are rarely able to achieve this so that the sticks must be blended or mixed prior to loading to achieve some uniformity. As a result of mixing the stick propellant, performance is not optimized.

FIGS. 2A and 2B are partial sectional views to illustrate prior art loading geometries for propellant sticks for a 120-MM shell 40 including a projectile 42 with six stabilizing guidance fins 44. Note that, although the slightly larger diameter (Ø=0.657 in. 16.69 MM) sticks 46 of FIG. 2A better fill the outer periphery than the smaller (Ø=0.625 in. 15.88 MM) sticks 48 of FIG. 2B, they leave larger voids about the fins and round sticks cannot accommodate both. Also, the interstitial void area is significant with round sticks in general.

FIG. 3 is a further schematic drawing that illustrates a vertical crossection of a fragment of a similar shell 50 without the baseplate containing projectile 52 with fins 54 and an ignition system as shown at 56. The loading of the cartridge 50 as can be seen from FIG. 3 requires at least eight different sizes or lengths of stick propellant (A–H) and in large quantities. Loading is by necessity labor intensive.

While perforated stick propellant provides configurations that yield high performance burns, as can readily be appreciated from the drawings, the loading of the shell also leaves considerable void space in the load. Perfect loading still leaves about 22% void space not counting perforations or kerf cuts.

Another method utilizing ribbed sheet propellant rolled into cylindrical sections has been tested on smaller caliber ammunition. This method used longitudinal ribs replacing perforations to assist ignition. The rolled method experienced difficulty in conformance to the projectile geometry, poor progressivity, poor flame spread and poor ignition characteristics.

Accordingly, it is a primary object of the present invention to produce a propellant loading which combines an increased charge load density with highly progressive burning achieved at a lower production cost.

Another object of the invention is to produce a propellant geometric configuration that uses fewer, larger grain shapes.

A further object of the invention is to provide a dense propellant loading geometry that enables convenient and efficient assembly of propellant within a straight or necked-down cartridge.

Yet another object of the invention is to provide a method of loading a propellant which uses a highly accurate, repeatable geometric shapes capable of sustaining high perforation density.

Other objects and advantages will appear to those skilled in the art in connection with familiarity with the descriptions and accounts of the invention in the following specification and drawings.

SUMMARY OF THE INVENTION

The present invention solves many of the prior art problems associated with large caliber munition propellant cartridge loading by the provision of propellant segments in the form of a reduced number of larger distinct mutually contiguous propellant stick shapes that yield more efficient use of propellant load space. The size and geometric configuration of the sticks yields exceptional uniformity of stick outer webs to allow very close packing of propellant sticks or grains and further enable large numbers of perforations per propellant grain to thereby achieve improved highly progressive burning and enhanced interior ballistic performance. The propellant load of the invention then exceeds the superior burning performance qualities of previous stick propellant loads at a reduced cost to produce because cartridge loading, assembly, packing (LAP)is made easier and safer.

With respect to loading density, by comparison, in a typical 120 millimeter tank munition, the total available propellant load can be increased by about 12 to 18 percent over a typical prior art in a conventional stick load for the same shell depending on whether round or hexagonal crossectional sticks are used. Moreover, the geometric configuration described by the stick shapes of the present invention can be accomplished using but four different extrusion dies. The preferred configuration includes two isosceles triangle stick or perforated pie propellant shapes (one of which is made trapezoidal to fit about a typical high intrusion projectile) a regular polygon shape and a modified parallelogram shape. The isosceles triangles and trapezoids are typically equilateral (60°) or modified equilateral triangles in the case of a projectile having a six-bladed fin to form a regular outer hexagonal shape about the projectile and a regular hexagonal annulus inside an outer peripheral row of sticks in the cartridge. These shapes can be produced with a reduced or minimized amount of skiving or milling of contour surfaces to conform the sticks to the cartridge case base and propellant fin/boom assembly. Each of the propellant sticks contains opposed partial/cuts or kerfs perpendicular to and connected with the longitudinal perforations formed upon extrusion to vent the perforations at regular short intervals to avoid occurrence of choked flow of combustion gases within the perforations and to maintain the extraordinary progressivity per grain associated with the numerous perforations per grain.

In the six-bladed fin system, the unique 60° or perforated pie geometric configuration enables convenient high density stick propellant charge loading within necked-down steel and brass cartridge cases, as well as with combustible or nitrocellulose cartridge cases. Accordingly, it will be recognized that in addition to the simultaneous minimization of wasted void volumes due to interstitial/chord spaces and increase in grain progressivity or the rate in which the controlled burn increases gas volume output, an important aspect of the invention is the ease of loading, assembling, packaging (LAP) of the munition round. This is accomplished by initial insertion of the ordered outer row of skived and kerfed sticks into the cartridge case and positioning them against the periphery of the cartridge case wall. The inclusion of the 60° equilateral triangle or pie shapes in the outer wall enables the creation of a stable hexagonal geometric annular recess centered to the configuration about the periphery of the cartridge. Thereafter, skived and kerfed sticks are assembled into a projectile stick bundle around the projectile fins/boom, together with a single hexagonal stick within the center of the projectile stick bundle placed beneath the fin section within the center of the stick bundle so that it buts against the fin hub. This bundle is taped together tightly at both ends to yield a hexagonal geometric projectile stick bundle which is then easily, readily assembled into the hexagonal annular stick recess configuration to yield the completed propellant system load. In a typical 120-MM cartridge, this involves the assembly of only about 25 sticks (FIG. 4) versus 50 to 65 conventional round sticks or grains required (FIGS. 2A and 2B). By maintaining the relative geometry of the stick grains fixed, and with appropriate dimensional scaling and optional addition/subtraction of perforation rows of each grain, the geometric grain design of the stick loading configuration of the present invention can be adapted to any size of large caliber cartridge including 60-MM, 105-MM, 120-MM and 140-MM involving projections with 6-bladed fins.

Furthermore, the conventional round or hexagonal grains or sticks do not permit the assembly of a stable outer peripheral row of skived and kerfed sticks into which the remainder can be assembled. This improvement is significant because the configuration of the invention facilitates the assembly of the propellant into conventional "necked down" brass or steel cartridge cases (e.g., the 105-MM conventional cartridge case) in as much as the outer row covers the top diameter reduction.

The loading configuration or system of the invention can be used with any conventional extrudable and otherwise processsable in new conventional stick propellant. These are made in a well-known manner normally from carpet rolled propellant which is dried, aged, pre-cut for extrusion and extruded with the desired perforation pattern, cut to length and kerf cut prior to assembly. Conventional propellant materials such as JA2 or other materials. The shapes are preferably fabricated from blended and rolled shaped propellant stock or from extruded bar stock. The fabrication process can be tailored to meet the requirements of the individual cartridge and performance requirements for maximum load, propellant load density and ballistic performance. The exterior geometry of each stick shape is typically fabricated using a die set and press or a water jet cutter or sawing process compatible with the propellant material and designed to more closely match the cartridge casing inside diameter or the geometry of the projectile. The water jet system can be programmed to process the propellant pieces for a full round in order and scrap propellant is typically recycled and reused. Additional details concerned with the preparation of the propellant are illustrated and described in the above-cross referenced co-pending application.

BRIEF DESCRIPTION OF THE DRAWINGS

In the drawings, wherein like numerals designate like parts throughout the same.

DETAILED DESCRIPTION

In accordance with the present invention, substantially higher propellant loading density is achieved in large caliber ammunition cartridges without sacrificing burning progression performance. The propellant of the present invention, not only enables a denser packing of the cartridge in respect to previous stick-type loads, it reduces the number of sticks required and greatly reduces the cost of loading-assembling-packing (LAP), increasing the ease and safety of assembly into the cartridge.

The embodiment of the detailed description illustrates the propellant system of the invention as used in a 120-MM KE cartridge in which the projectile has a symmetrical six-bladed fin. It should be understood that, in this regard, the propellant system can be modified for use with other rounds including those using projectiles having a different number of fins, the detailed embodiment being illustrative and not intended to be limiting with respect to the invention.

Figure 4:
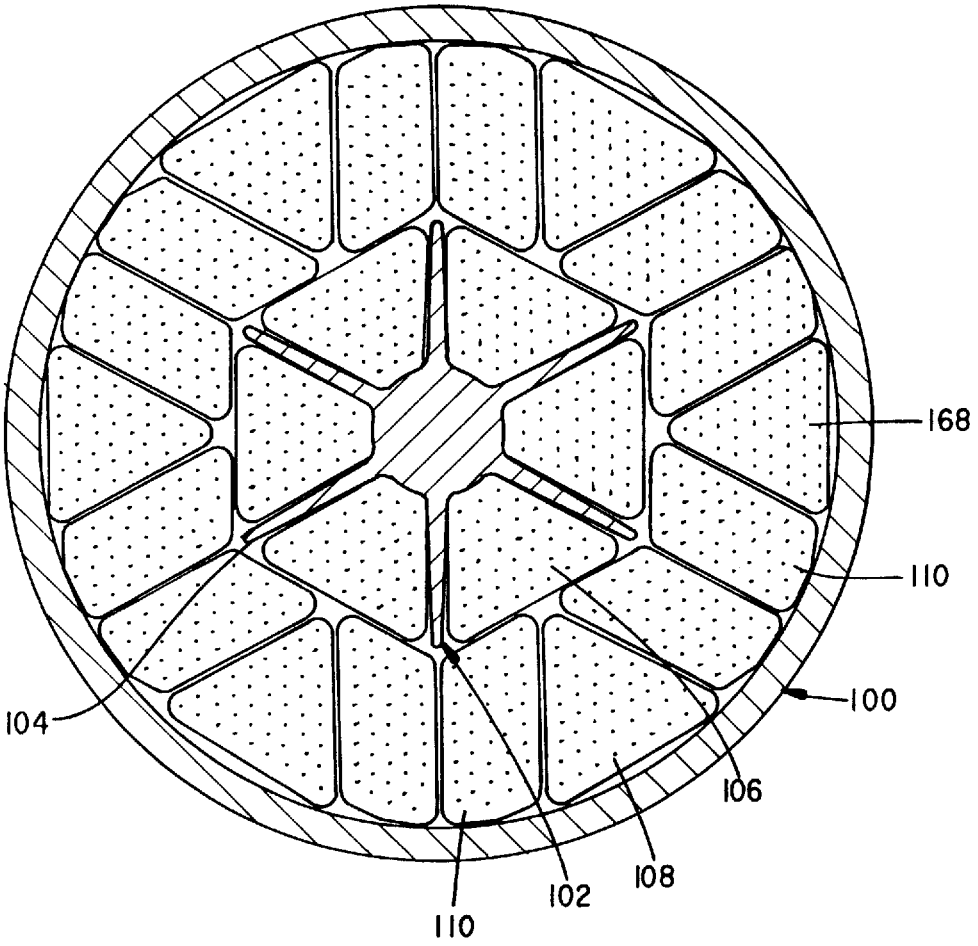
FIG. 4 is a sectional view through a 120-MM KE cartridge which includes the projectile fin and illustrates a propellant geometry arrangement in accordance with the invention.

FIG. 4 depicts a sectional view through a typical 120-MM KE cartridge illustrating a propellant geometry arrangement in accordance with the invention. The configuration includes a cartridge casing 100, which may be fabricated of nitrocellulose or other combustible material and includes a kinetic energy projectile 102 having six symmetrically disposed radially extending fin blades 104 carried within the cartridge shell 100. An inner ring including a plurality of elongate trapezoidal shaped core stick segments 106 which extend along and between the six symmetrical fin blades 104 are provided which with the projectile 102 present a hexagonal peripheral projectile stick bundle shape.

Figure 5A:
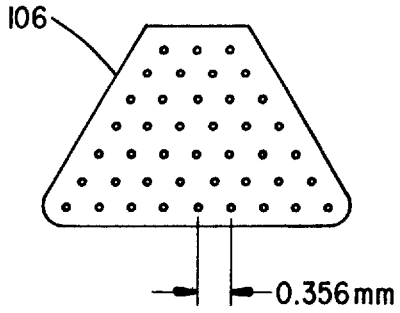
FIGS. 5A–5D illustrate each of the individual stick propellant grains in accordance with the preferred embodiment.
Figure 5B:
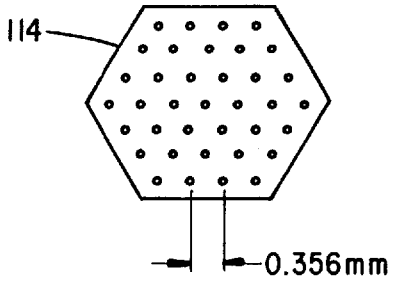
Figure 5C:
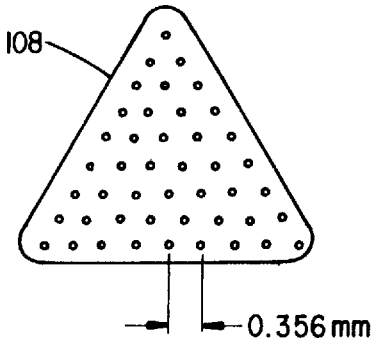
Figure 5D:
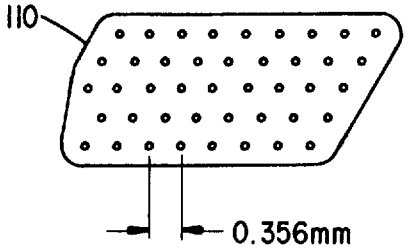
Figure 7A:
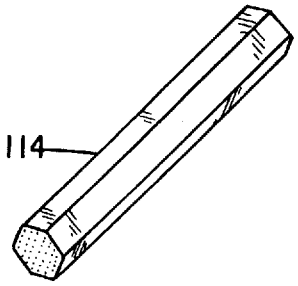
FIGS. 7A–7D illustrate a prospective view of each of the component propellant sticks of FIGS. 5A–5D, each of the three larger sticks exhibiting skived/milled contour surfaces at either end which permit the sticks to conform to the cartridge case base and projectile fin/boom assembly.
Figure 7B:
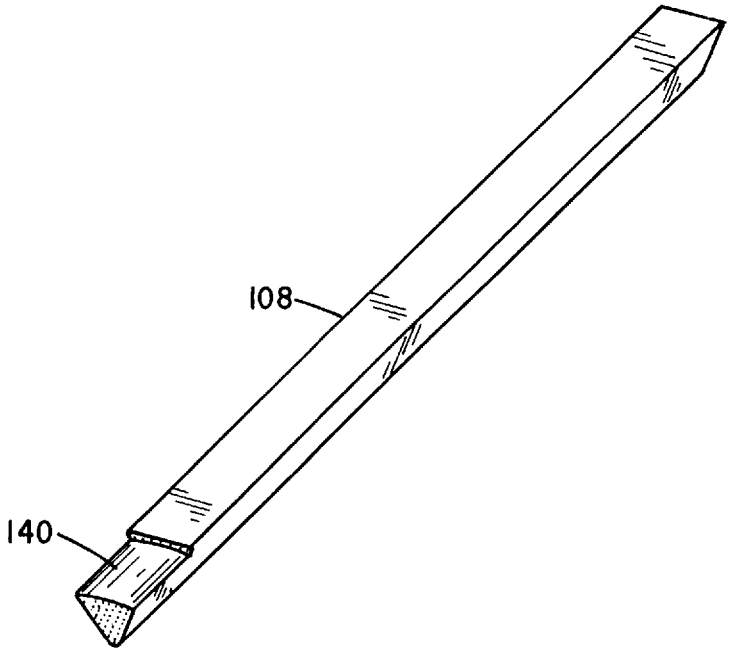

An outer ring of elongated shaped stick segments is provided including equilateral triangle segments 108 and generally quadrilateral shaped stick segments 110 which, when disposed is illustrated in FIG. 4, provide an outer ring of propellant sticks which substantially occupies the available propellant volume in the cartridge case outside the projectile stick bundle. The outer ring forms a stable interior annulus generally shaped to just accommodate the peripheral projectile stick bundle geometry and an outer geometry generally following the casing interior without requiring a great deal of special shaping, i.e., shiving or milling. Thus, the inner and outer stick rings require but three different geometric shapes of elongated stick segments. It should further be noted that the configuration of the outer ring of the equilateral triangle and modified quadrilateral shapes forms of itself a stable annulus about the periphery of the cartridge 100 such that after assembly of the outer ring, the projectile stick bundle or core segment including the projectile 102 and the trapezoidal segments 106 can be inserted as a unit within the outer ring to complete the loading. A further hexagonal segment, illustrated in FIGS. 5C and 7A at 114, is utilized as a central stick in the projectile bundle beneath the aft end of the projectile to complete the projectile bundle. As can be seen in FIG. 7A, this stick is considerably shorter than the sticks 106, 108 and 110.

FIGS. 5A–5D illustrate the four basic propellant stick shapes of the invention, particularly with respect to the perforation (perf) patterns employed. With respect to the perfs, the typical center-to-center distance is approximately 0.14 in. (3.56 MM) and the typical perforation diameter is 0.030 in. (0.762 MM) which results in an average internal web thickness equal to about 0.11 in. (2.79 MM). A relatively uniform outer peripheral web thickness equal to approximately one half of the internal web thickness is provided. In this manner, for a 120-MM round, the trapezoidal shapes 106 are typically 42 perf; the equilateral triangle shapes 108, 45 perf; and the modified quadrilateral shapes 110 typically 43 perf. The shorter hexagonal sections are typically 37 perf, as illustrated.

Figure 6:
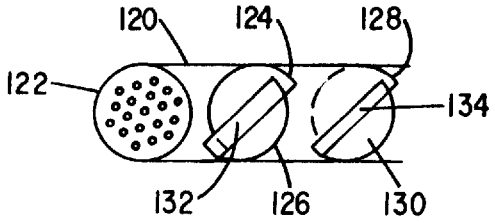
FIG. 6 illustrates a partial cut kerf technique for venting stick propellant.

FIG. 6 depicts a schematic representation of a preferred method of kerf cutting shapes including the shapes used for the propellant load of the present invention. In that illustration, stick 120 having a pattern series of longitudinal perforations 122 is subjected to a plurality of oppositely administered partial kerf cuts at regular intervals as illustrated at 124, 126, 128 and 130. Note that each pair of partial kerf cuts overlaps as at 132 and 134 to insure that all of the perforations 122 are intersected by the partial cuts or kerfs. The partial cuts or kerfs must be spaced at uniform intervals along the length of the stick at a spacing sufficiently short to provide adequate venting so as to avoid occurrence of choked flow combustion gases within the perforations.

Figures 7C, 7D:
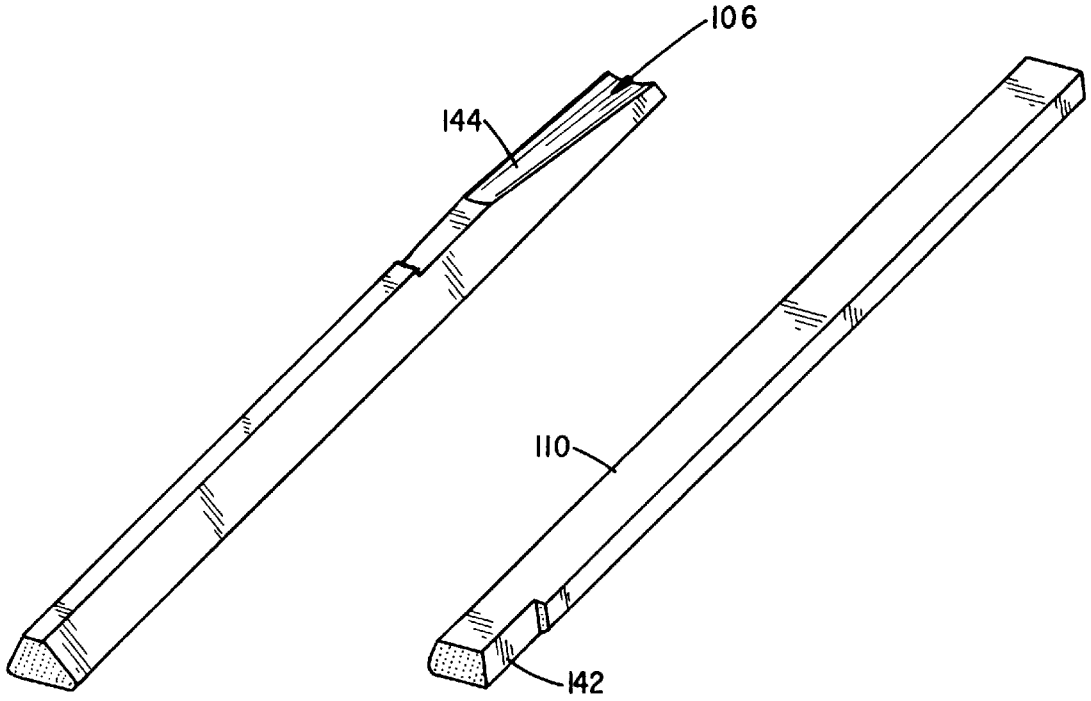

The FIGS. 7A–7D further illustrate relative full length perspective views of the propellant grain geometry for each of the individual stick propellant grains. Note that the triangular stick 108 in FIG. 7B and modified quadrilateral stick 110 in FIG. 7D are notched at the lower end to accommodate constrictions in the lower cartridge case at 140 and 142 respectively. In FIG. 7C, the upper portion of a typical trapezoidal shape 106 exhibits skived/milled contour internal surfaces to permit the stick to conform to the projectile fin/boom assembly at 144.

Figure 1A:
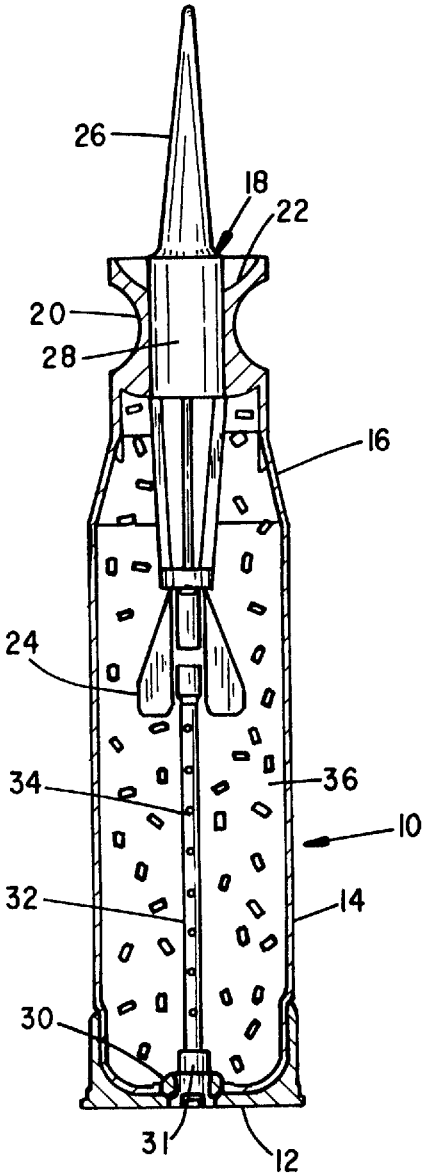
FIG. 1A (PRIOR ART)
FIG. 1A is a schematic view, partially in section, of a typical large caliber round including a KE projectile of a class suitable for use with the propellant system of the invention shown loaded with an extended granular shaped propellant of the prior art.
Figure 1B:
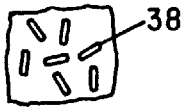
FIG. 1B (PRIOR ART)
FIG. 1B is an enlarged fragment showing the propellant of FIG. 1A.
Figure 8:
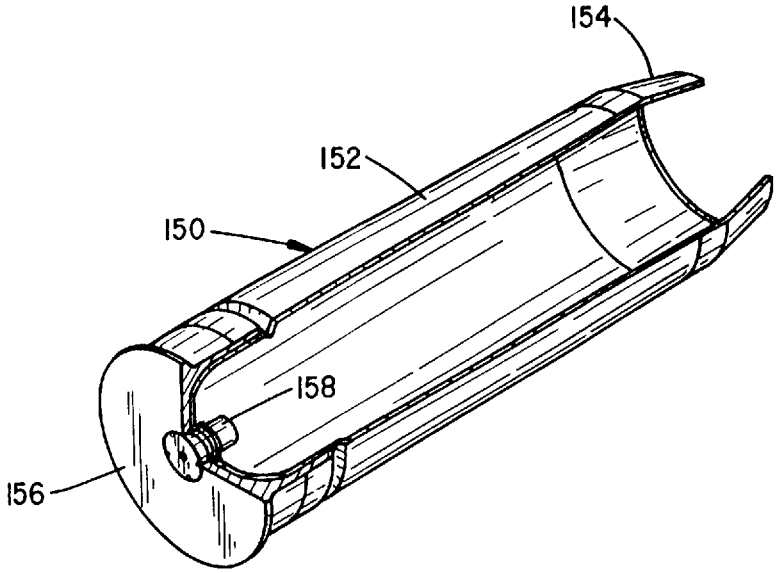
FIG. 8 is a perspective view, with parts cut away, illustrating a typical 120-MM combustible cartridge case for use with the propellant system of the present invention.
Figure 9:
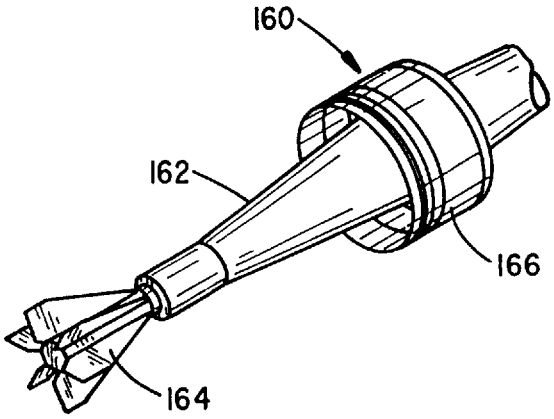
FIG. 9 is a fragmentary perspective view illustrating part of a kinetic energy (KE) projectile usable in the cartridge case of FIG. 8.
Figure 10:
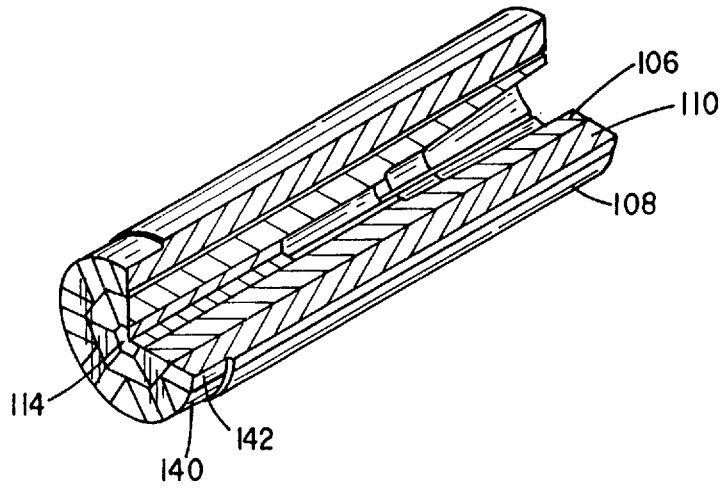
FIG. 10 is a perspective view, with parts cut away, illustrating the interlocked stick propellant grains of the invention mutually arranged so as to conform to a combustible cartridge case of FIG. 8 and the projectile fin/boom arrangement of FIG. 9.

FIGS. 8, 9 and 10 further illustrate three views which correspond to illustrating the interlocking components of a typical large caliber kinetic energy cartridge such as the 120-MM round. In this regard, FIG. 8 is a perspective view, with parts cut away illustrating a typical large caliber, possibly 120-MM combustible cartridge case for use with the propellant system of the present invention. The case is shown generally at 150 and includes a combustible sidewall 152 having a tapered nose at 154 and including a baseplate 156 which is equipped with a base ignition system including a stub base primer 158, a conventional center-core type primer as shown in FIG. 1 is unnecessary with the loading configuration of the present invention.

FIG. 10 is a perspective view, with parts cut away, illustrating the interlocked stick propellant grains of the invention illustrated in the crossectional view of FIG. 4 arranged so as to fit in the cartridge case of FIG. 8, but without the presence of the kinetic energy projectile shown generally at 160 in the fragmentary perspective view of FIG. 9. The projectile including a central body or boom 162, a 6-bladed fin system 164 and a discarding Sabot system part of which is illustrated at 166 and which mounts in the corresponding area of the cartridge shell 150 with the boom and fin nesting in the correspondingly shaped propellant grains as partially illustrated in the perspective view of FIG. 10.

Figure 2A:
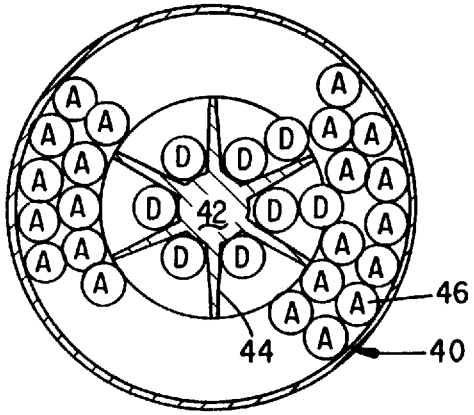
FIG. 2A (PRIOR ART)
FIGS. 2A and 2B represent sectional views through a large caliber cartridge illustrating prior art stick propellant configurations.
Figure 2B:
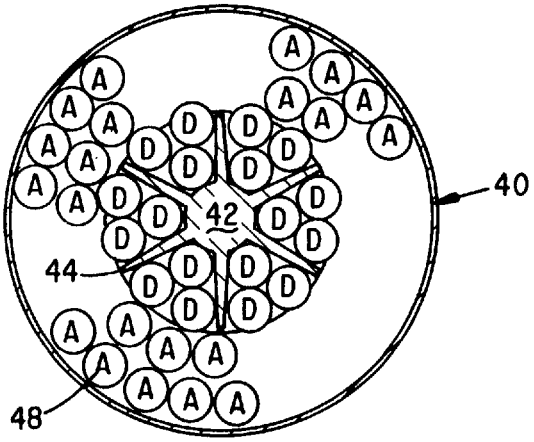
Figure 3:
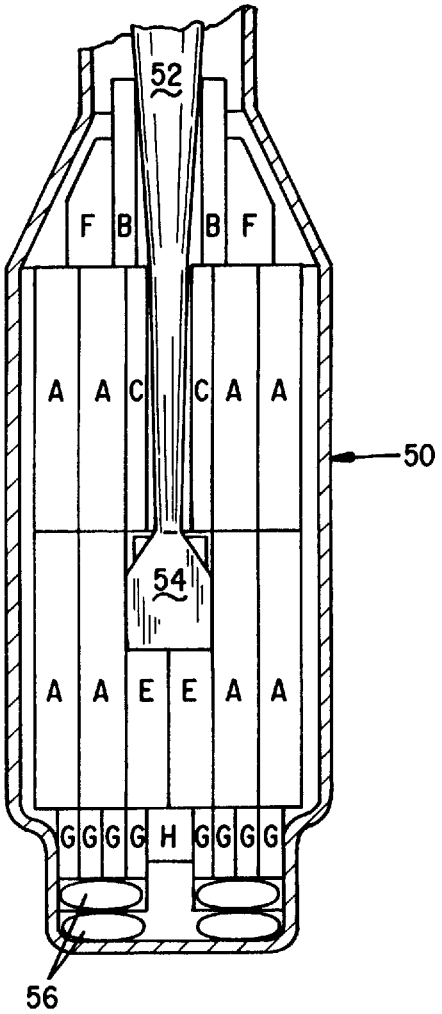
FIG. 3 (PRIOR ART)
FIG. 3 is a fragmentary, vertical view, partially in section, of another prior art large caliber munition utilizing a perforated stick extruded propellant arrangement.

It is clear from a comparison of the crossection of FIGS. 2A and 2B with FIG. 4 that the earlier stick geometries involve considerable wasted (interstitial or chord) space even when closely packed in a "nearest neighbor" configuration when compared with the perforated pie or wedge and quadrilateral propellant system of the invention shown in FIG. 4. Furthermore, the configuration of the present invention as illustrated in FIGS. 4 and 10 requires only 25 perforated propellant grains versus 50 to 65 sticks required to load the rounds illustrated in FIGS. 2A and 2B.

In addition, the outer peripheral ring which includes triangular shapes 108 sandwiched between oppositely disposed pairs of modified quadrilateral sticks 110 itself forms a stable ring about the periphery of the shell 100 or 150, such that this outer ring can be readily assembled utilizing a final equilateral triangular stick 108 as the key to completing the circular arch. As is clear from the FIGS. 4 and 10, this outer annulus yields a stable hexagonal recess within the cartridge of a diameter less than or equal to that of the necked-down portion of the cartridge illustrated at 154 in FIG. 8. This readily accommodates the combination of the inner ring of six trapezoidal sticks 106 in combination with the kinetic energy projectile and the central lower stick 114.

This, of course, enables a relatively simple procedure for propellant LAP for straight or conventional necked-down cartridges of any type including brass/steel cartridge cases typically used for 105-MM rounds. Thus, the outer row of skived and kerfed sticks can be assembled into the cartridge case and positioned against the cartridge case wall and keyed into a stable annular stick configuration. Thereafter, the skived and kerfed sticks designated around the projectile fin/boom can be assembled together with the aft single hexagonal stick being placed within the center of the stick bundle so that it butts against the fin hub. This bundle may be taped tightly together at both ends forming a tight hexagonal stick bundle which can thereafter be readily inserted as a unit into the central void or recess space central to the outer row assembled about the periphery of a cartridge case wall thereby easily completing the propellant loading of the cartridge. The projectile stick bundle, including the hexagonal stick, readily fits through the narrow portion of the necked-down cartridge as at 154.

It has been found that the configuration of the invention enables very high loading density (e.g., in excess of 1.0 kg/liter) of propellant within a cartridge and the relatively high perforation density allowed in the larger geometric shaped grains produces extraordinary progressivity per grain due to the numerous, closely spaced perforations per grain. The selected geometric shapes not only enable convenient and efficient assembly of the propellant (LAP) within a cartridge, but as seen in FIG. 8 enable "base ignition" by the use of a stub primer eliminated the need for a "center-core type primer". The loading density and progressivity improvements directly contribute to enhance interior ballistic performance. The utilization of fewer distinctly shaped stick grains represents a significant efficiency advantage regarding human labor savings for cartridge load-assembly-pack (LAP) and, because of the ease of assembly, represent an inherrant increase in LAP safety by, for example, reducing chances for accidental propellant ignition due to propellant friction sensitivity.

The unique geometric configuration further allows the size of the grains to be changed while maintaining the relative geometry of the stick grains fixed so that by using appropriate dimensional scaling and optional addition/ subtraction of perforation rows of each grain, the geometric design of the propellant configuration of the invention can be adapted to any size of large caliber cartridge, for example, 60-MM, 105-MM, 120-MM and 140-MM involving projectiles with 6-bladed fins.

The system is compatible with any extrudable or otherwise conveniently processable stick propellant material exemplified by JA2 and has been found to increase the loading by 12 to 18 percent over conventional round or hexagonal stick grains. The ability to utilize a closely packed perforation pattern in the grains in combination with overlapping kerf cuts enables the reaction surface to increase at a tremendous rate during the burn, thereby imparting extraordinary progressivity to the burn. This progressivity improvement represents an important aspect of the improved propellant loading system of the invention, together with increase loading density and ease of assembly.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. A propellant load arrangement for a medium, or large, caliber munition cartridge including a finned ballistic projectile including a fin having a plurality of blades comprising:

(a) an inner ring comprising a plurality of elongate trapezoidal shaped core stick segments of propellant material having parallel inner and outer bases assembled in an ordered arrangement, the interfaces of the segments facing and being juxtaposed and generally parallel to the longitudinal axis of the projectile, the segments extending between the fins thereof, the outer surfaces of the inner ring segments forming a regular peripheral projectile stick bundle of specific geometric shape having the same number of sides as the number of fins of the projectile;

(b) an outer ring comprising plurality of elongate triangular and generally quadrilateral shaped outer sticks of propellant material and having inner and outer surfaces, the outer sticks being assembled in an ordered geometric arrangement generally configured to occupy the available peripheral propellant volume of the cartridge case outside the inner ring, said outer ring forming a stable interior annulus generally shaped to accommodate the core geometric shape and producing an outer geometry generally following the case interior geometry;

(c) a central stick in said projectile bundle having a regular geometric shape having a number of sides corresponding to the number of fins in said projectile and adapted to be accommodated beneath the body of said projectile in an opening defined by the inner trapezoid bases in said bundle beneath said fin; and (d) wherein each stick segment of the arrangement, where necessary, further has a shaped central interior or exterior recessed geometry to accommodate the corresponding geometry of any interfering internal cartridge shape or projectile geometry present.

2. The propellant load arrangement of claim 1 wherein the number of blades in the fin is 6.

3. The propellant load arrangement of claim 2 wherein said plurality of triangular outer stick segments are equilateral triangular shapes.

4. The load arrangement of claim 1 wherein the outer stick segments as assembled in said cartridge form a stable geometric central recess matching said projectile stick bundle.

5. The load arrangement of claim 3 wherein the outer stick segments as assembled in said cartridge form a stable geometric central recess matching said projectile stick bundle.

6. The load arrangement of claim 1 wherein said core stick and said outer sticks are provided with a pattern of longitudinal perforations having an average web of 0.11 in. (2.79 MM) and a perforation diameter of 0.03 in. (0.762 MM).

7. The load arrangement of claim 3 wherein said core stick and said outer sticks are provided with a pattern of longitudinal perforations having an average web of 0.11 in. (2.79 MM) and a perforation diameter of 0.03 in. (0.762 MM).

8. The load arrangement of claim 4 wherein said cartridge is necked-down near the top thereby having a top opening smaller than the casing diameter and said projectile stick bundle is accommodated by the smaller top opening.

9. The load arrangement of claim 5 wherein the munition cartridge is a 120-MM cartridge.

10. A propellant load arrangement for a medium, or large, caliber munition cartridge including a finned ballistic projectile having a six-bladed fin comprising:

(a) a projectile stick bundle comprising a plurality of elongate trapezoidal shaped core sticks of propellant material having parallel inner and outer bases assembled in an ordered arrangement, the interfaces of the segments facing and being juxtaposed and generally parallel to the longitudinal axis of the projectile, a segment extending between each pair of adjacent blades, the outer surfaces of the outer bases forming a regular hexagonal projectile stick bundle;

(b) an outer ring comprising plurality of elongate equilateral triangular and generally quadrilateral shaped outer sticks of propellant material and having inner and outer surfaces, the outer sticks being assembled in an ordered geometric arrangement generally configured to occupy the available peripheral propellant volume of the cartridge case outside the projectile stick bundle, said outer ring forming a stable interior recess shaped to match the hexagonal stick bundle;

(c) a central stick in said projectile stick bundle having a regular hexagonal geometric shape and adapted to be accommodated in said projectile stick bundle beneath the body of said projectile in a hexagonal opening defined by the inner trapezoid bases in said bundle beneath said fin; and (d) wherein each stick of the arrangement, where necessary, further has a shaped central interior or exterior recessed geometry to accommodate the corresponding geometry of any interfering internal cartridge shape or projectile geometry present.

11. The load arrangement of claim 10 wherein the core and outer stick segments as assembled in said cartridge form a stable geometric central recess able to accommodate said projectile stick bundle.

12. The load arrangement of claim 10 wherein said core stick and said outer sticks are provided with a pattern of longitudinal perforations having an average web of 0.11 in. (2.79 MM) and a perforation diameter of 0.03 in. (0.762 MM).

* * * * *